US005222719A

United States Patent [19]

Effner

[11] Patent Number: 5,222,719

[45] Date of Patent: Jun. 29, 1993

[54] MEANS FOR HOLDING WORKPIECE FOR MACHINING

[75] Inventor: James F. Effner, Walker, Mich.

[73] Assignee: Jamesway Products & Services Inc., Walker, Mich.

[21] Appl. No.: 837,040

[22] Filed: Feb. 18, 1992

[51] Int. Cl.[5] ..... B25B 11/00

[52] U.S. Cl. ..... 269/21

[58] Field of Search ..... 269/21, 266, 309, 900; 51/235; 279/3 R; 409/225, 219, 161

[56] References Cited

U.S. PATENT DOCUMENTS

| | | | |
|---|---|---|---|
| 3,307,819 | 3/1967 | Cocito | 269/21 |
| 3,694,894 | 10/1972 | Jelinek et al. | 269/21 |
| 4,088,312 | 5/1978 | Frosch et al. | 269/21 |
| 4,357,006 | 11/1982 | Hayes | 269/21 |
| 4,527,783 | 7/1985 | Collora et al. | 269/21 |
| 4,684,113 | 8/1987 | Douglas et al. | 269/21 |
| 4,723,766 | 2/1988 | Beeding | 269/21 |
| 4,805,887 | 2/1989 | Ray | 269/21 |
| 5,028,182 | 7/1991 | Park et al. | 269/21 |

*Primary Examiner*—Robert C. Watson

*Attorney, Agent, or Firm*—Price, Heneveld, Cooper, DeWitt & Litton

[57] ABSTRACT

A workpiece support and means for holding the workpiece on a machine tool to support it in an elevated position above the flat surface of a hollow workpiece supporting bed of the machine tool is disclosed. The bed has a plurality of openings arranged in a pattern over each of which an individual pod may be placed. Each pod is hollow and through it air is withdrawn into the machine to cause the workpiece, due to air pressure differential, to seat firmly against it. When the machine is inactive each pod may be inverted and then inserted to seal the opening into which it is seated. Each opening is surrounded by a circumferential recess to receive the lip at the pod's larger end. This lip is received in this recess both when the pod is upright to support and hold a workpiece and when it is inverted to seat into and to close the opening in the supporting bed. As many of the pods are placed in upright position as are needed to engage, hold and support a particular workpiece.

16 Claims, 3 Drawing Sheets

MEANS FOR HOLDING WORKPIECE FOR MACHINING

SUMMARY OF THE INVENTION

In machine tools having a workpiece supporting surface, which surface has a plurality of spaced openings therethrough arranged in a uniform pattern throughout the surface and each of which communicates with a vacuum source beneath the surface and a plurality of one-piece work supports, which in one position communicate with the vacuum source and each of which, when not required, can be inverted and seated in one of the openings. When so inverted and seated, each support serves to close the opening against movement of air therethrough. When upright, each support seats in the same opening, extends above the surface and provides a chamber exposed to the under surface of a workpiece seated thereon which chamber is surrounded by a workpiece engaging seal and is in open communication with the source of the vacuum.

BACKGROUND OF THE INVENTION

Machine tools, such as those for boring, cutting, routing, planing and grooving, among other machining procedures, have long used workpiece support surfaces equipped with a vacuum source to hold the workpieces during machining operations. When this technique of workpiece support can be used, it has a number of advantages. The workpiece support and location means can be greatly simplified and its mass is reduced. In many cases, an arrangement of simple stops and locator pins can be substituted for complex and costly jigs or fixtures. This type of part location is relatively simple to mount on and remove from the workpiece support surface. This materially reduces setup and changeover time, making it economically feasible to use the machine for so-called "short run products".

BRIEF DESCRIPTION OF THE INVENTION

The invention provides a simple, workpiece support for holding workpieces of very widely different designs on a work surface during machining, using a vacuum to provide sufficient grip to positively hold and stabilize the workpiece during the operation. The workpiece support surface of the machine is provided with a plurality of openings, each connected to the vacuum source to provide a vacuum hold down for the workpiece. Each of these openings has a pod which, in erected position, exposes the workpiece to a vacuum and in unerected position closes the opening and seals it. By placing the support pod in either its upright or inverted position, each support controls whether the opening in which it is located is active or closed, permitting the arrangement of active openings to correspond to the shape of the workpiece to be secured by either inverting or uprighting a pattern of supports which corresponds to the size and shape of the workpiece to be machined. Thus, the invention makes it possible to reshape quickly the pattern of workpiece hold down to the particular shape and size of the workpiece involved. Further, the invention provides a relatively inexpensive means by which the presently costly, labor intensive means of placing and anchoring each workpiece can be replaced by a simple, easy to use and dependable workpiece support and retention means. This can be done rapidly and without tools. Use of the invention imposes no restriction on the operation of the equipment or the nature of the tools employed when the invention is used.

The invention provides a substantially lower cost and more effective workpiece support and holder. It has no moving or delicate parts and thereby eliminates the problem of wear, breakage and malfunction. Also, it is versatile, strong and accurate. It is also quick, easy and adaptable for use in the manufacture of a wide range of products.

DESCRIPTION OF THE PREFERRED EMBODIMENT

Figure 1:
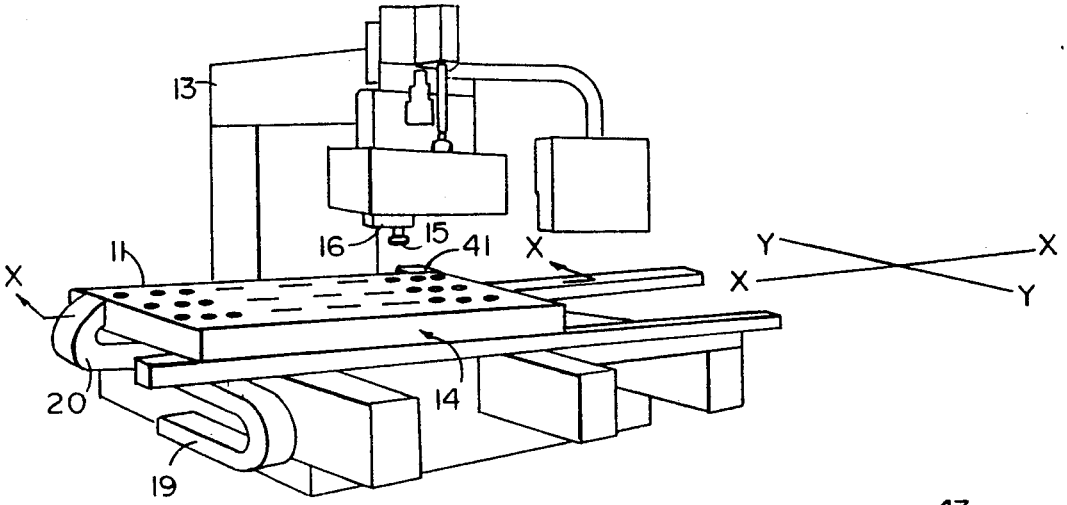
FIG. 1 is an oblique view of a machine tool having a work surface equipped for use of this invention, the work surface being partially illustrated schematically.

Referring to FIG. 1, the numeral 10 identifies a machine which, for illustrative purposes, is tooled to function as a router. However, it could be any one of a number of machines in which the work support surface 11 is moved in at least two directions (x and y axes) in relation to a tool 12 which rotates about either a vertical or a horizontal axis. It also can be used in a gantry-type machine in which the work and its support are moved along one or both of the x and y axes in a horizontal plane with respect to the tool. It can also be used in a gantry-type machine in which movement along one of these axes is effected by the gantry while movement along the other axis is effected by movement of the workpiece and its support. In each of these arrangements, the tool is mounted on a beam. The tool may be stationary or capable of transverse movement lengthwise of the beam above the work surface and, in some cases, movement along both the x and y axes. In the description next following, the invention will be described as applied to equipment in which the work is machined while mounted on a bed or work surface which moves along both the x and y axes while the tool's position remains stationary.

The machine has an elongated bed 14 mounting the work support surface 11. The bed is mounted for movement along both the x and y axes, that is, both laterally and fore and aft with respect to the machine's main body 13 and the tool 12. In the machine, as illustrated, a single tool, such as a router head 15, is secured to the spindle 16 and is rotated about a vertical axis. In the particular construction illustrated, the axis of the spindle, except for vertical movement, remains in a fixed location. Movement of the bed or work surface 11 toward and away from the main body 13 of the machine (y axis) is controlled by the drive 19 and lengthwise movement of the bed 14 (x axis) is controlled by the drive 20. All of the preceding structure is conventional in the machine tool industry and is background and environmental to this invention.

Figure 9:
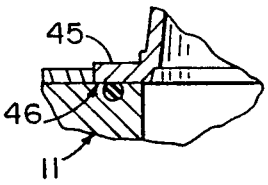
FIG. 9 is an enlarged, fragmentary, sectional elevation view of the article support in article support position.
Figure 6:
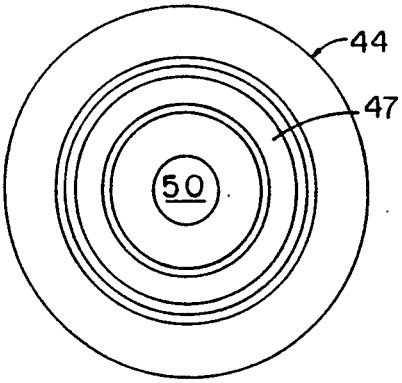
FIG. 6 is a view taken along the same plane as FIG. 5 but showing the article support, inverted or inactive as in FIG. 3.
Figure 10:
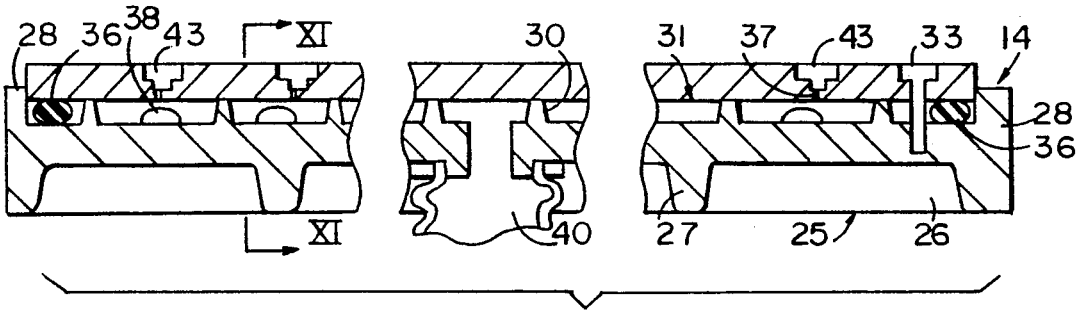
FIG. 10 is a fragmentary, sectional, elevation view taken along the plane X—X of FIG. 1.
Figure 11:
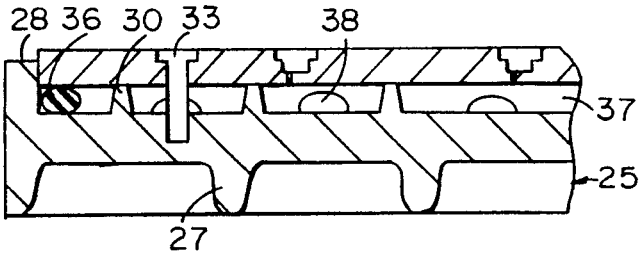
FIG. 11 is a fragmentary, sectional view taken along the plane XI—XI of FIG. 10.
Figure 12:
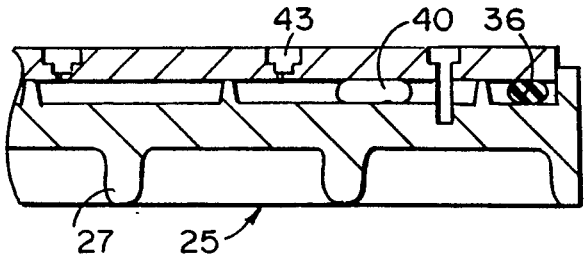
FIG. 12 is a fragmentary, sectional view taken along the plane XII—XII of FIG. 10.

If the machine is one designed exclusively for use with this invention, rather than one which has been modified to use this invention, it has the construction illustrated in FIGS. 10, 11 and 12. However, a number of existing machines can be refitted to employ the construction about to be described. In the construction specifically designed for this invention, the work support bed 14 has a main base member 25 including a base or primary panel 26 reinforced by depending ribs 27. This base member is preferably a single, cast unit the size of a single machine surface which could be, for example, four by four or four by eight feet, or even larger. The depending ribs 27 normally extend both lengthwise and transversely to form a grid pattern resistant to deflection due to the mass and weight of the workpiece to be machined and tool pressure exerted during machining. The base member also has an upstanding, peripheral flange 28 surrounding and defining an upwardly opening chamber 29. The chamber 29 has a plurality of upstanding ridges 30, the tops of which have been machined to form a common plane 31 (FIG. 9). While the height of the ridges 30 can vary from one machine to another, a convenient height is about one inch. The peripheral flange 28 extends above the plane 31 defined by the tops of the ridges 30 and defines an upwardly opening recess surrounded by the peripheral flange 28. The top of the peripheral flange may be in the same plane as the top surface of the panel 11 or of a lesser height, as illustrated in FIG. 10. Seated in this recess is the work surface panel 11. It is of a size to just seat within the recess. The panel can be of steel but preferably is of aluminum or nonmetallic materials, such as plywood, particle board or similar panel-type products. Preferably, it is at least one inch thick. This panel must have a thickness such that it can seat the article support pods which will be described subsequently. Thus, its thickness should not be less than three-quarters of an inch and normally need not be more than one and a half inches. All other considerations aside, the strength of the work surface panel or spoil board 11 must be such that it will not deflect under the weight of the part or parts loaded on it, coupled with the downward acting tool pressure imposed during machining operations because it must accurately position the workpiece being machined with respect to the tool or tools 12. Failure to do this will result in improperly machined and, thus, reject parts. How thick the panel 3 must be to satisfy this requirement will also depend, in part, on the spacing between the ridges 30. For example, if the ridges are arranged in a square pattern providing a span of six to eight inches between ribs, the thickness of the panel can be significantly less than a base member with the ridges 30 arranged in a grid spaced at twelve inch intervals.

The work surface panel 11 is secured to the base member 25 by bolts 33 provided at suitable spacings, such as at twelve inch spacings. These bolts must be of a size and arranged at a spacing which will positively hold the work surface panel 11 against any movement whatsoever with respect to the base member 25. Failure to do this will result in an improperly machined product. As the panel 11 is pulled down by the bolts 33 to seat on the ridges 30, it also contacts and partially compresses the gasket 36 adjacent the peripheral flange 28 effecting, an airtight seal entirely surrounding the chamber 29 between the base member 25 and the work surface panel 11. Because, by the tightening the bolts 33 the panel 11 is pulled firmly against the tops of the ridges 30, it is necessary that these tops be machined to a uniform plane which is parallel to the plane of movement of the panel. Failure to do this could result in variations in the vertical position of the workpiece.

Figure 2:
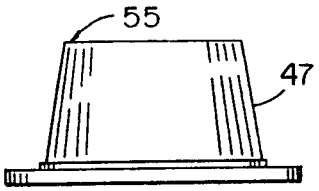
FIG. 2 is a side elevation view of one of the article supports or pods.
Figure 5:
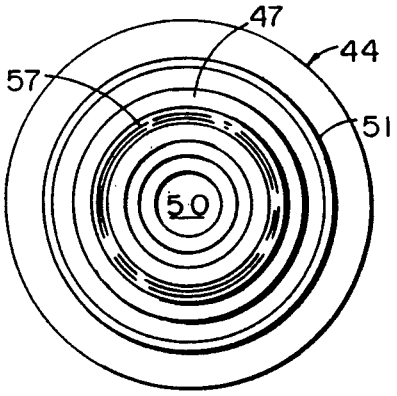
FIG. 5 is a view of the article support or pod taken along the plane V—V of FIG. 4.

The panel 11 has a pattern of identical, uniformly arranged recesses or pod openings its upper surface. These openings or recesses are arranged in rows both laterally and lengthwise of the panel. Each has a depth and diameter such that it will accommodate one of the pods 44 (FIGS. 2, 3 and 4) when the pod is inverted for storage. However, these recesses do not extend entirely through the panel 11. This construction requires the panel 11 to have sufficient thickness that the pod 44, when inverted for storage, can be stored within its recess.

Figure 8:
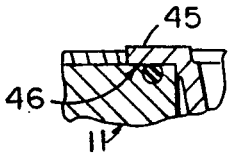
FIG. 8 is an enlarged, fragmentary, sectional elevation view of the article support in inactive position.

Each of the pods 44 is circular and has a peripheral flange 45 which seats in a circumferential channel 46 (FIGS. 8 and 9) recessed into the surface of the panel 11 surrounding a pod opening 43. The flange 44 surrounds central boss 47 which extends in offset manner from the flange 45 and surrounds the central chamber 49 within the pod. The end of the chamber opposite from the flange 45 has a central opening 50. The thickness of the flange 45 is greater than the depth of the channel 46. Thus, when the pod is inverted for storage, a portion of the flange 45 will remain above the top surface of the panel 11 (FIG. 8). Preferably, the central boss 47 adjacent the flange 45 has an external annular rib 51 of a size to closely seat within a pod opening 43 but not to bind with the walls of that opening.

The end 54 of the central boss 47 is flat and provides an annular surface 55 into which a seat 56 is recessed to hold a an 0-ring type seal 57. The depth of the seat is such that the seal 57, in its uncompressed condition, projects above the surface 55. The seal 57 is secured to the pod by suitable means, such as an adhesive, so that it will not become detached from the pod as the pod is manipulated between erected and storage positions.

Figure 4:
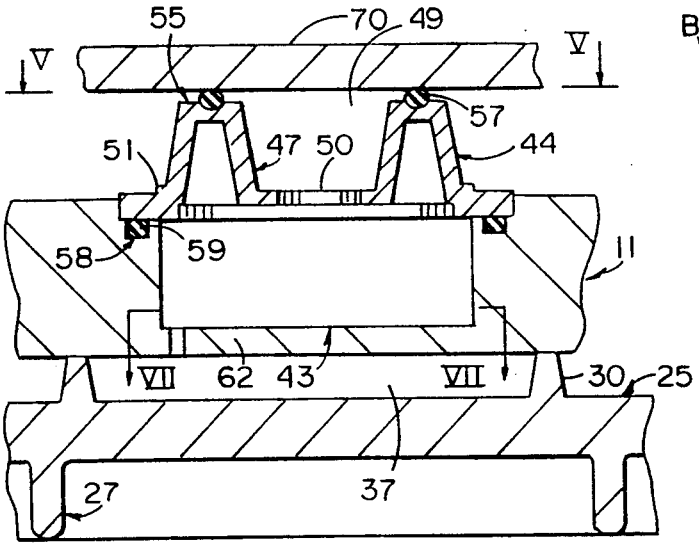
FIG. 4 is a view similar to FIG. 3 but with the article support or pod in erected article support position and seated on the machine bed.
Figure 3:
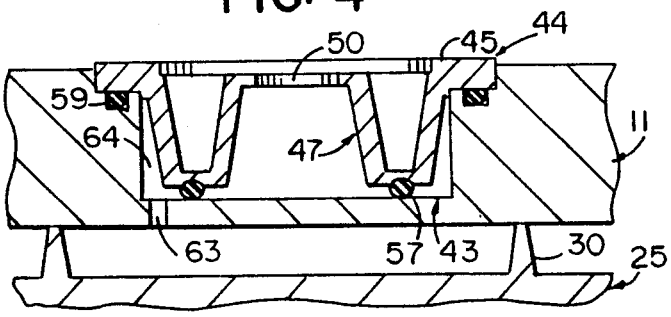
FIG. 3 is an enlarged, fragmentary, sectional view of the work surface with the article support in inactive or closed position.

The surface of the recessed circumferential channel 46 has an annular recessed seat 58 to receive a ring-like gasket or seal 59 similar to the seal 57, except for diameter. This gasket-like seal 59, normally projects above the surface of the channel 46 to assure a positive, air excluding engagement with the peripheral flange 45 of the pod when the pod is in either storage or erected position as illustrated in FIGS. 3 and 4.

Figure 7:
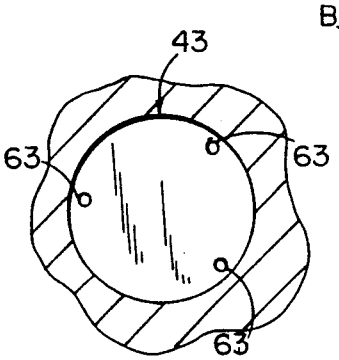
FIG. 7 is a fragmentary view of the opening in the work surface taken along the plane VII—VII of FIG. 4.

The bottom of the pod opening is closed by a relatively thin wall 62 integral with the body of the work surface which remains after the pod opening is formed because the depth of the opening is less than the thickness of the panel. One or more vent openings 63 extend through the wall 62 to vent the pod opening 43 to the compartments 37 of the chamber 29. While three of these openings are illustrated in FIG. 7, it will be recognized that the number of these can be more or less than three. It is, however, important that these openings be positioned adjacent the side wall of the pod opening 43 so that they communicate only with the narrow, annular chamber 64 which remains when the inverted pod 44 is stored in the pod opening 43 (FIG. 3). These vent openings 63 can be small because they are needed to exhaust only the air remaining in the adjacent narrow annular chamber together with air which may leak past the gaskets or seals 57 and 59.

The air from the pods, when the pods are upright, is drawn into the compartments 37 of the chamber 29. The individual compartments 37 of the chamber 29, formed by the ridges 30, are all interconnected by openings or passageways 38 through the ridges (FIG. 11), permitting air to readily move through the compartments to the central exhaust port 40 (FIG. 10) such as the one which extends downwardly through the base member 25. As illustrated in FIGS. 1 and 12, and, as has already been explained, in some cases, the exhaust port 40 may be located at one end of the panel. In any case, the exhaust port 40 is connected to a conduit 41 (FIG. 1) which, if the vacuum chamber structure moves, must be flexible because it must follow the movements of the bed 14 along one or both of the x and y axes for the full distance the bed is moved. When movement of the bed must be accommodated, the exhaust port for the vacuum chamber can be through one or both ends or at one side of the bed. In any case, the conduit is connected to equipment for exhausting air from the vacuum chamber 29. The conduits and air pump equipment are not illustrated since they are conventional and long used with equipment of this type.

The air exhaust equipment need not have large capacity since, once the pressure in the vacuum chamber has been reduced to the desired level, the only air to be exhausted will be that which enters because of leaks in the seals with the workpiece or seals at the unused workpiece supports or the seals surrounding the chamber containing the compartments 37. In the case of work support beds of substantial size, the bed may be equipped with two air exhaust ports, preferably located adjacent opposite ends of the bed to maintain a substantially uniform work retention ability throughout the entire work support surface.

A typical pod will have an area within the chamber surrounded by the gasket 57 and acting on the underside of the workpiece of approximately three square inches. The air pump creating the vacuum will have a capacity of approximately 100–300 $ft^3$ per minute. This will generate a vacuum created force on the workpiece pressing it against the gasket 57 equal to 12–26 inches of mercury. This amount of air vacuum force coupled with the use of a rubber-like plastic for the gasket 57, having a high coefficient of surface friction, will hold the workpiece against any tool induced lateral movement. Particularly is this true when several of the pods are acting on the same workpiece since the holding force in the $$\text{lb/in}^2 = \frac{Hg'' \times \text{surface in}^2}{2}.$$

Figure 14:
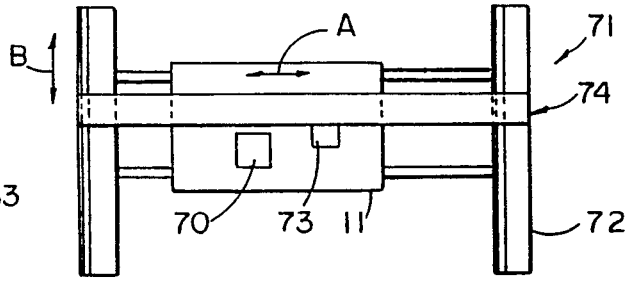
FIG. 14 is a partially schematic plan view of this invention used into a different gantry-type machine.
Figure 13:
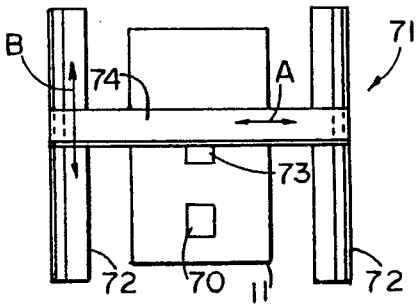
FIG. 13 is a partially schematic plan view of this invention used in a gantry-type machine.
Figure 15:
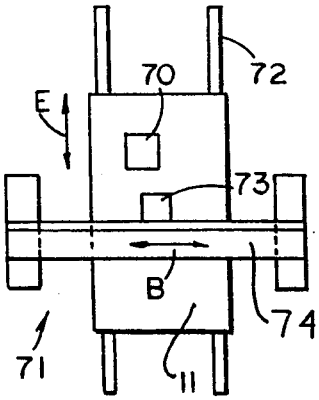
FIG. 15 is a partially schematic plan view of this invention used in another type of gantry machine.

The preceding has described a machine having a stationary tool cantilevered or bridged over the work surface which work surface moves along both the x and y axes beneath the stationary tool. Many machines are of gantry construction in which the tool is mounted on a beam supported on both ends which beam extends over the work support surface. Examples of such machines are illustrated in FIGS. 13, 14 and 15. In the following description, it will be understood that the workpiece is mounted on a panel or work surface 11 by means of pods 44 in their erected or upright position as illustrated in FIG. 4.

As schematically illustrated in FIG. 13, the workpiece 70 is supported beneath the gantry 71. The workpiece is located between the tracks 72 and is stationary. The tool and its drive 73 for machining the workpiece is moveable along the overhead beam 74 of the gantry as indicated by the arrow A. The beam 74 is moved lengthwise of the workpiece along the tracks 72 as indicated by the arrow B. Thus, the combination of these movements permits the tool 73 to be positioned anywhere over a workpiece 70 on the surface 11.

In FIG. 14, the tool and its drive 73 do not move along the overhead beam 74. However, the workpiece 70 is moveable beneath the tool 73 between the ends of the overhead beam 74 of the gantry 71 because it is carried by the surface 11 in the direction of the arrow A. Relocation of the tool lengthwise of the tracks 72 is effected by movement of the overhead beam 74 of the gantry lengthwise of the tracks 72 in the direction of the arrow B. By the combination of the movement of the gantry 71 lengthwise of its tracks 72 and of the workpiece 70 between the ends of the gantry, the tool can be positioned to work on the workpiece anywhere along the x and y axes.

In FIG. 15, the gantry 71 is stationary but the tool and the power head 73 moves along the beam 74 as indicated by the letter B. In this arrangement, the workpiece support surface 11 is moved along tracks 72 as indicated by the arrow E. Again, by the combination of movements, the tool is able to machine anywhere on the surface 11 that the workpiece 70 may be located.

This invention provides a number of advantages. It can be applied to all or substantially all existing vacuum work holding systems. An existing system may be modified to adapt it to use this invention by replacing the presently used work holding panel or spoil board with a panel having openings to accommodate the pods of this invention. Since this panel can be one of aluminum, plastics, wood or fiberboard the necessary machining to produce the required hole pattern can be done by the machine itself, on which the system will be used or by any machine shop facility relatively inexpensively. The pods can be molded by any one of many injection molding facilities from a wide range of materials. The only limitations on the manufacture of the pods is that they be strong enough to withstand the weight of the product being machined together with the lateral and vertical pressures exerted by the tools during machining. They must also be accurate and capable of long and repeated use without dimensional change or loss of structural stability and integrity. A preferred material from which to mold the individual pods is acetylbutyl sterate (ABS plastic)

Another significant advantage of the invention is that, by locating the workpiece above the surface of the machine bed by use of the pods, the workpiece can be machined from the side or from a side angle as well as vertically. Thus, it materially adds to the versatility of the equipment. This has not been illustrated because so using does not change the invention, its structure or its operation, the change being merely how it is used.

One of the major advantages of this invention is cost. Existing work holding systems for unitizing a vacuum to retain the workpiece, use work holding means which have a relatively short useful life because they are so-called dedicated tooling, that is, useable only for manufacture of a single, particular product of a particular design. They cannot be modified or otherwise adapted for manufacture of any other product. Thus, when no longer needed for the particular product, they are discarded. Even these so-called, low cost holding devices may each cost hundreds or even thousands of dollars. In the case of products expected to be used on longer, dedicated production cycles, the cost of the work holder or jig may exceed a hundred thousand dollars and at the end of the production run have only scrap value.

In contrast to this, the present invention enables the work holding bed of the machine to be adapted to support and retain the workpiece simply by turning the required number of pods into upright or active position as are necessary to properly support and retain the workpiece. When production of the particular workpiece is completed, the machine can be prepared to machine a different workpiece simply by rearranging the pattern of upright pods to retain the new product. Thus, there is no dedicated work holding tooling. Each of the pods can be used over and over again since they are not dedicated and have commercial rather than specialized use. This results in a very substantial reduction in cost.

Having described the preferred embodiment of my invention, it will be understood that various modifications of it can be made without departing from its principles and such are to be considered as included in the hereinafter appended claims unless the language of the claims clearly states otherwise.

We claim:

1. Means for supporting a workpiece on a supporting bed having a plurality of recessed openings therein connected to a source of vacuum, a plurality of upstanding hollow annular workpiece supports each seated over and surrounding one of said openings and each having a peripheral flange equipped with means forming a pneumatic seal with said supporting bed, each workpiece support in workpiece support position having a flat upper surface with an opening therethrough, a gasket surrounding said opening for forming a pneumatic seal around said opening with a workpiece resting on said seal whereby the vacuum generated by said source will act upon the surface of the workpiece in the area surrounded by said seal, said workpiece support holding a workpiece seated thereon above and spaced from said supporting bed, each of said workpiece supports being individually invertible and when so inverted sealing the opening in which it is located to terminate air flow therethrough.

2. Means for supporting a workpiece on a supporting bed having a plurality of recessed openings therein connected to a source of vacuum, each of said openings extending partially through said panel and being closed at one end except for an exhaust opening through said one end adjacent a side wall of said opening, said workpiece supporting means being circular, having a central body member with a central opening extending axially therethrough surrounded by and extending axially from a flange at one end, each of said openings in said panel being surrounded by a recess for receiving said flange when said supporting means is in workpiece engaging position, said supporting means when inverted being recessed in one of said openings and having a seal engaging said closed end of the opening except for said exhaust opening.

3. Means for supporting and holding a workpiece on a supporting bed, said bed being hollow and having an internal chamber connected to a source of vacuum, said bed having a panel forming its upper surface, said panel having a plurality of identical openings recessed therein, the lower end of each of said openings being closed except for an opening adjacent a side wall of the opening, a separate workpiece support means for each of said openings, each support means having a radially extending flange at one end and a tubular portion extending axially therefrom and centered therewith, each support means in erected position seating over one of said openings and having a central passage therethrough in said tubular portion surrounded by a workpiece engaging gasket at the end opposite from said flange whereby only the workpiece resting on said end of said support means is exposed to said vacuum through said support means, said support means being capable of being inverted and said tubular portion received in the opening in the panel with said gasket means engaging said bottom end of said opening for sealing the opening in said support means against movement of air therethrough.

4. The means for supporting and holding a workpiece on a support bed as described in claim 3 wherein each of said workpiece support means is circular, has a body of truncated conical shape surrounded at one end by a radially outwardly extending flange and a flat end web parallel with said flange extending radially inwardly from said body at the end opposite from said flange, said end web having a central opening therethrough, seal forming means on the external end surface of said conical body for forming an air passage seal between it and a panel-like element seated on it.

5. Means for supporting a workpiece on a workpiece supporting bed during machining, said bed being hollow and connected to a source of vacuum, a plurality of uniformly spaced recessed openings in said bed each having radially extending annular channel means at its periphery, each of said recessed openings extending partially through said panel and being connected to the source of the vacuum only through a small opening adjacent the side wall of said recessed openings, an individual workpiece support seated in each of said openings, each support having flange means at one end for seating in said annular channel, each support having a central body portion extending in an axially offset direction from said flange and having an end panel surrounding a central opening therethrough, said central body portion forming an axial passage through said support, said supporting means when said flange is seated in the radially extending recess means of one of said openings supporting a workpiece above and in spaced relation to said bed and having a gasket surrounding said opening and engageable by a workpiece to prevent air entering said opening in response to the presence of a vacuum therein, each of said workpiece supports being invertible with said central body portion telescopically received in the opening over which it had been erected and by means of said gasket engaging the bottom of said recess to seal the opening in the center of said workpiece support from said vacuum source.

6. Means for supporting a workpiece on a workpiece supporting bed as described in claim 5 wherein said gasket engages the end of said recess radially inwardly of the side walls of said opening.

7. Means for supporting a workpiece on a workpiece supporting bed as described in claim 5 wherein a further gasket is provided in the recess surrounding each of said openings for sealing each opening against entrance of air into said opening between said flange and said bed both when the support means is upright and when it is inverted.

8. In the method of supporting a workpiece for machining including the steps of providing a chamber having a flat top surface and a source of vacuum for evacuating the chamber, providing a plurality of identical openings in said top surface communicating with said chamber, providing a separate individual closure means for each of said openings and seating it in inverted position in the opening to seal the opening against movement of air therethrough, uprighting those of said closure means which are needed to support a workpiece and in so doing selecting those of the closure means which collectively form a pattern conforming to the shape of the workpiece to be formed and returning them to the same opening they had previously sealed to form a conduit through the center thereof through which the vacuum is exposed to the workpiece and exposing the surface of the workpiece seated over the inverted closure means to the vacuum to pull it tightly against the closure means, means surrounding said conduit at said uprighted end to prevent entrance of air between the workpiece and the workpiece support.

9. In the method of supporting a workpiece for machining as described in claim 8 wherein only those of the closure means required to support and retain the workpiece are inverted to grip the workpiece.

10. Means for supporting a workpiece on a workpiece supporting bed having a plurality of recessed openings therein each being blind except for an opening therein adjacent the side wall thereof, each opening surrounded by a shallow annular channel, an individual workpiece support cooperating with each opening, each support having a tubular central axially extending portion surrounded at one end by a radially extending flange adapted to seat in said annular channel, both ends of said workpiece support having a central opening surrounded by a gasket, the gasket at the end thereof opposite from said flange being adapted to engage the surface of a workpiece support and form a seal therewith and when the workpiece support is inverted form a seal with the bottom of said recessed opening to isolate the central opening of said workpiece support from said opening at the side wall of the recessed opening.

11. The means for supporting a workpiece as described in claim 10 wherein said central portion is frusto-conical in shape with the end of lesser diameter being remote from said flange.

12. The means for supporting a workpiece as described in claim 10 wherein said openings are arranged in a uniform pattern throughout the top surface of said workpiece supporting bed.

13. The means for supporting a workpiece as described in claim 10 wherein a portion of said flange extends above the surface of said workpiece supporting bed when said workpiece support is in inverted position.

14. Means for supporting a workpiece on a supporting bed having a plurality of recessed openings therein, each having a closed bottom, except for means connecting it to a source of vacuum, a plurality of elongated hollow annular workpiece supports each seated over one of said openings and having a peripheral flange at one end equipped with a gasket which when seated in one of said openings forms a pneumatic seal with bed, each workpiece support having a flat upper surface spaced vertically from said flange and an having an opening therethrough, a gasket surrounding said opening for forming a pneumatic seal surrounding said opening when a workpiece rests on said seal whereby the vacuum generated by said source will act upon the surface of the workpiece in the area surrounded by said seal, each said workpiece support being invertible to be seated in recessed position within the opening and form a seal with said supporting bed preventing air from passing into said supporting bed.

15. The means for supporting a workpiece as described in claim 14 wherein said workpiece supports hold the workpiece in an elevated position spaced above said bed.

16. The means for supporting a workpiece as described in claim 15 wherein each individual workpiece support is separately capable of being inverted and recessed in its recessed opening, each support, when recessed, forming a seal between it and said closed bottom, said vacuum connecting means being between said seal and the peripheral wall of said recessed opening.

* * * * *